US006899956B2

(12) United States Patent
Block et al.

(10) Patent No.: US 6,899,956 B2
(45) Date of Patent: May 31, 2005

(54) METAL COLORING PROCESS AND SOLUTIONS THEREFOR

(75) Inventors: William V. Block, Apple Valley, MN (US); Bryce D. Devine, St. Paul, MN (US)

(73) Assignee: Birchwood Laboratories, Inc., Eden Prairie, MN (US)

( * ) Notice: Subject to any disclaimer, the term of this patent is extended or adjusted under 35 U.S.C. 154(b) by 374 days.

(21) Appl. No.: 10/138,603

(22) Filed: May 3, 2002

(65) Prior Publication Data

US 2003/0205298 A1 Nov. 6, 2003

(51) Int. Cl.[7] ..... B32B 15/04

(52) U.S. Cl. ..... 428/469; 428/472.2; 148/243; 148/272; 148/287; 106/14.14; 252/389.62; 252/390

(58) Field of Search ..... 148/243, 272, 148/287; 106/14.14; 252/389.62, 390; 428/469, 472.2

(56) References Cited

U.S. PATENT DOCUMENTS

| | | | | |
|---|---|---|---|---|
| 2,148,331 A | * | 2/1939 | Weisberg et al. | 148/243 |
| 2,960,420 A | | 11/1960 | Mitchell | 148/6.24 |
| 3,899,367 A | | 8/1975 | Mitchell | 148/6.24 |
| 3,929,514 A | | 12/1975 | Houlihan et al. | 148/6.14 |
| 4,017,335 A | | 4/1977 | Maloney | 148/6.15 R |
| 4,140,551 A | | 2/1979 | Jones | 148/6.15 Z |
| 4,220,486 A | | 9/1980 | Matsushima et al. | 148/6.15 R |
| 4,298,405 A | | 11/1981 | Saus et al. | 148/6.15 R |
| 4,565,585 A | | 1/1986 | Matsuda | 148/6.15 R |
| 4,591,397 A | | 5/1986 | Jones et al. | 148/15.5 |
| 4,728,365 A | | 3/1988 | Jarvi | 106/1.05 |
| 4,789,409 A | | 12/1988 | Jarvi | 148/6.24 |
| 5,078,812 A | | 1/1992 | McCoy et al. | 148/270 |
| 5,089,349 A | | 2/1992 | Kaiser | 428/427.1 |
| 5,104,463 A | | 4/1992 | Menke | 148/264 |
| 5,234,509 A | | 8/1993 | Tull et al. | 148/246 |
| 5,580,063 A | | 12/1996 | Edwards | 273/378 |
| 5,591,275 A | | 1/1997 | Miyafuji et al. | 148/246 |
| 5,595,611 A | | 1/1997 | Boulos et al. | 148/259 |
| 5,601,663 A | | 2/1997 | Rungta et al. | 148/271 |
| 5,667,599 A | | 9/1997 | Rungta et al. | 148/259 |
| 5,704,995 A | | 1/1998 | Bradley | 148/265 |
| 5,723,183 A | | 3/1998 | Williams et al. | 427/409 |
| 5,728,235 A | | 3/1998 | Boulos et al. | 148/257 |
| 5,904,785 A | | 5/1999 | Aizawa et al. | 148/259 |
| 5,919,318 A | | 7/1999 | Brands et al. | 148/260 |
| 6,019,858 A | | 2/2000 | Sienkowski et al. | 148/260 |
| 6,171,409 B1 | | 1/2001 | Hamacher et al. | 148/253 |
| 6,179,934 B1 | | 1/2001 | Kawakami et al. | 148/260 |
| 6,193,815 B1 | | 2/2001 | Wada et al. | 148/247 |
| 6,309,476 B1 | | 10/2001 | Ravenscroft et al. | 148/252 |

OTHER PUBLICATIONS

Cotton and Wilkinson, Advanced Inorganic Chemistry—A Comprehensive Text, 1962, Interscience Publishers, pp. 847–863.
Mark Ruhland of Birchwood Casey, Blackening of Ferrous Metals, 1999 PF Directory.
Heatbath, New Blackening Technology literature, March 1996.
Hubbard–Hall, Activated Black Magic Plus literature.
Du–Lite, Guide to Hot Black Oxide Processes, The Du–Lite Corporation 1994.
Godding, The Basics of Black Oxide Finishing, Products Finishing Feb. 1990.
Godding, Why Black Oxide!, Products Finishing Apr. 1986.
Daniels, Black–Oxide Basics, Products Finishing Jul. 1992.
Birchwood Casey, In–House Blackening with No EPA Regulated Chemicals brochure.
Birchwood Casey, Guide to Room Temperature Antiquing without Hazardous Effluent brochure.
Birchwood Casey, Your Practical Guide and Cost Analysis brochure, Aug. 1997.

* cited by examiner

*Primary Examiner*—Andrew L. Oltmans
(74) *Attorney, Agent, or Firm*—Gray Plant Mooty Mooty & Bennett, P.A.; Malcolm D. Reid

(57) ABSTRACT

This invention includes improvements to a method for forming a chemical conversion coating on ferrous metal substrates, to the chemical solutions used in the coating and to the articles coated thereby. A first oxidation applies a molecular iron/oxygen-enriched intermediate coating, such as a dicarboxylate or phosphate, to a ferrous substrate. A coloring procedure (a second oxidation) follows the first oxidation procedure, using a heated oxidizing solution that reacts with the iron and oxygen enriched intermediate coating to form magnetite ($Fe_3O_4$). The result is the formation of a brown or black finish. An appropriate rust preventive topcoat may seal the substrate. The finish affords protection, a degree of lubricity to aid assembly, break-in of sliding surfaces, provides anti-galling protection and an adherent base for paint finishes. Improvements to the first oxidation include a broader range of operating conditions, the addition of a hydroxylamine accelerator or a wetting agent, and operation by slurry deposition. Improvements to the second oxidation include a broader range of operating conditions, and the addition of a sequestrant or thio-based accelerator.

25 Claims, No Drawings

METAL COLORING PROCESS AND SOLUTIONS THEREFOR

BACKGROUND OF THE INVENTION

1. Field of the Invention

This invention relates to improvements to a process for the formation of a hybrid chemical conversion coating on ferrous metal substrates, consisting of an iron/oxygen rich intermediate coating and a top layer of magnetite. This invention also relates to ferrous metal substrates coated according to the presently disclosed improved process. This invention further includes improvements to the oxidation solution used in oxidizing the iron/oxygen rich intermediate coating to the final magnetite containing top layer. This invention also includes improvements to a seven-step procedure for preparing a ferrous metal substrate with a magnetite containing coating.

2. Description of the Related Art

Prior, commonly-assigned U.S. Pat. No. 6,309,476 and Ser. No. 09/710,187 describe a method for forming a chemical conversion coating on ferrous metal substrates, the chemical solutions used in the coating and the articles coated thereby. U.S. Pat. No. 6,309,476 and Ser. No. 09/710,187 will be referred to herein as the Ravenscroft disclosures. Those inventions modified and combined features of two existing, but previously unrelated, coating technologies, to form a hybrid conversion coating. The Ravenscroft disclosures described molecular iron/oxygen-enriche intermediate coatings, such as a dicarboyxlate or phosphate, applied to a ferrous substrate by a first oxidation. The intermediate coating pre-conditioned the substrate to form a surface rich in molecular iron and oxygen in a form easily accessible for further reaction. The first oxidation reaction of the Ravenscroft disclosures preceded a coloring process (second oxidation) using a heated oxidizing solution that reacted with the iron and oxygen enriched intermediate coating to form magnetite. The result of the process of the Ravenscroft disclosures was the formation of a brown or black finish under milder and safer conditions than had previously been seen with conventional caustic blackening procedures, due to the chemical reaction between the intermediate coating and the second oxidation solution. When sealed with an appropriate rust preventive topcoat, the result of the Ravenscroft procedures was an ultra-thin, attractive and protective finish applied through immersion techniques. The finish was a final protective coating on a fabricated metal article and afforded a degree of lubricity to aid assembly, break-in of sliding surfaces, provided anti-galling protection, and provided an adherent base for paint finishes.

The established art of coloring ferrous metals has revolved principally around methods for producing black coatings. Since the 1950's, the most commonly used commercial method for blackening ferrous metals has been the caustic black oxidizing process. This disclosure will examine this method, along with the ferrous oxalate conversion coating on ferrous metal substrate and the iron phosphatizing process.

Caustic black oxidizing: This process uses sodium hydroxide, sodium nitrate and sodium nitrite as oxidizing agents, operating at about pH 14, at temperatures of about 285–305° F. A black coating forms during exposures of about 10–30 minutes. This process forms a magnetite ($Fe_3O_4$) deposit, approximately 1 micron thick, by reacting with the metallic iron substrate in situ. Although the process produces high quality black finishes when operated properly, it has the disadvantage of requiring high temperatures and highly concentrated solutions (700–1000 grams per liter) to carry out the reaction.

During the course of operation, this reaction consumes oxidizing salts and the solution boils off significant quantities of water. Adding these materials back to the solution maintains proper operating conditions. However, adding sodium hydroxide to water, being a highly exothermic reaction, is quite hazardous because the operating solution is already boiling. Likewise, adding make-up water to a solution that is already at 285–305° F. causes the water to boil instantly if not added very slowly and carefully. Consequently, the operation of the process poses severe safety hazards for personnel, due to the dangers involved in normal system operation and maintenance. These hazardous conditions may be difficult to justify in the manufacturing environments of modern industry. In addition, normal operating conditions typically entail heavy sludge formation in the process tank, difficulty in disposal of the spent solutions (due to extremely high concentrations), and variable quality on certain metals, including tool steel alloys, sintered iron articles or other porous substrates. Without the use of highly skilled operators, this process may result in poor quality finishes. It is common to see undesirable red/brown finishes on certain alloys or salt leaching on porous substrates. As a result, the process largely requires the use of professional metal finishers who possess specialized knowledge and experience in dealing with hazardous materials.

Ferrous oxalate conversion coating: The development of this coating originally provided resulted in a metal forming lubricant and anti-galling coating for mating parts. Application of the finish is generally at about ambient temperatures. The finish is about one micron thick and opaque gray in color. When sealed with a rust preventive topcoat, the oxalate offers some degree of corrosion protection. Used more commonly in the 1950's, the oxalate process is rarely used today, having given way to the several phosphate processes on the market, which offer more beneficial properties in terms of lubrication and/or paint adhesion.

Iron phosphate conversion coating: These coatings are widely used in the metal finishing industry as pretreatments to enhance paint adhesion and corrosion resistance on ferrous metal substrates. With a coating thickness of about 1 micron, the amorphous deposit forms at temperatures of about 70–130° F. by a mildly acid solution that may also contain cleaning agents. The iron phosphate process has proven to be a very versatile and effective option in paint lines and other metal finishing process lines.

There have been several patents issued over the years that relate to blackening processes. For purposes of this invention, however, the following prior patent references directly relate to oxalate and phosphate conversion coatings on ferrous metal substrates and to the caustic black oxidizing of ferrous metal substrates:

| U.S. Pat. No. | Date | Subject |
|---|---|---|
| 2,774,696 | Dec. 18, 1956 | Oxalate Coatings on Chromium Alloy Substrates |
| 2,791,525 | May 7, 1957 | Chlorate Accelerated Oxalate Coatings on Ferrous Metals for Forming Lubricity and Paint Adhesion |
| 2,805,696 | Sep. 10, 1957 | Molybdenum Accelerated Oxalate Coatings |
| 2,835,616 | May 20, 1958 | Method of Processing Ferrous Metals to Form Oxalate Coatings |

-continued

| U.S. Pat. No. | Date | Subject |
|---|---|---|
| 2,850,417 | Sep. 2, 1958 | m-Nitrobenzene Sulfonate Accelerated Oxalates on Ferrous Metals |
| 2,960,420 | Nov. 15, 1960 | Composition and Process for Black Oxidizing of Ferrous Metals Using Mercapto-Based Accelerators and naphthalene based Wetting Agents |
| 3,121,033 | Feb. 11, 1964 | Oxalates on Stainless Steels |
| 3,481,762 | Dec. 2, 1969 | Manganous Oxalates Sealed with Graphite and Oil for Forming Lubricity |
| 3,632,452 | Jan. 4, 1972 | Stannous Accelerated Oxalates on Stainless Steels |
| 3,649,371 | Mar. 14, 1972 | Fluoride Modified Oxalates |
| 3,806,375 | Apr. 23, 1975 | Hexamine/$SO_2$ Accelerated Oxalates |
| 3,879,237 | Apr. 22, 1975 | Manganese, Fluoride, Sulfide Accelerated Oxalates |
| 3,899,367 | Aug. 12, 1975 | Composition and Process for Black Oxidizing of Ferrous Metals Using Molybdic Acids on Tool Steels |
| 4,017,335 | Apr. 12, 1977 | pH Stabilized Composition and Method for Iron Phosphatizing of Ferrous Metal Surfaces |
| 5,104,463 | Apr. 14, 1992 | Composition and Process for Caustic Oxidizing of Stainless Steels Using Chromate Accelerators |

All but one of these oxalate patents pertain to the formation of a ferrous oxalate conversion coating on ferrous metal substrates using various accelerators. These oxalates are function as coatings to aid in assembly or provide forming lubricity, etc. These coatings serve as deformable or crushable boundary layers at the metal surface, thereby protecting the base metal during contact with another surface.

The caustic black oxidizing patents focus on compositions and processes that oxidize the metallic iron substrate to a magnetite, $Fe_3O_4$, as described in U.S. Pat. No. 2,960,420. Actually, when examining the stoichiometry of the $Fe_3O_4$, one can see that the iron is not in either a purely ferrous (II) or ferric (III) oxidation state. Perhaps a more precise description of the material is that of a mixed salt, ferrosoferric oxide, or $FeO.Fe_2O_3$, which exhibits both ferrous and ferric iron. The conventional caustic oxidizing processes all depend on the ability of the operating solution to oxidize metallic iron to both ferrous (II) and ferric (III) oxidation states to form the mixed oxide $FeO.Fe_2O_3$.

The process described in U.S. Pat. No. 4,017,335 is representative of the state of the art, focusing on the well-known primary phosphatizing mechanism. In addition, this same patent illustrates incorporation of a cleaning agent, pH stabilizer into the oxidizing solution to effectively clean lightly soiled ferrous articles, and iron phosphatize them in a single step.

SUMMARY OF THE INVENTION

This invention describes improvements to a method and composition for forming aesthetically pleasing and protective, and functionally useful magnetite coatings on ferrous metal substrates as described in the Ravenscroft disclosures. This disclosure specifically incorporates the disclosures of this application and this patent by reference into this disclosure in their entireties. The mechanism involves a first oxidation to provide an intermediate coating on the metallic iron substrate, such as a ferrous dicarboxylate or phosphate coating, which primarily acts as a precursor to the magnetite. The improvements to this first oxidation include wider operating conditions and additional reagents than were described in the Ravenscroft disclosures. The first oxidation may use an aqueous oxalic acid solution at broadened process ranges. An accelerator for the first oxidation may be a hydroxylamine accelerator, in addition to the organic and inorganic nitro compounds exemplified in the Ravenscroft disclosures. Certain additional advantages are noted when the first oxidation is carried out by a slurry deposition.

This invention also includes certain improvements to the second oxidation, that is, the formation of the magnetite from the intermediate coating surface abundant in both molecular iron and molecular oxygen. These improvements include wider operating conditions and additional reagents than were described in the Ravenscroft disclosures. The second oxidation may include an aqueous oxidizing solution containing alkali metal hydroxide at a concentration of about 20–1000 grams per liter. The second oxidation may use additional thio-based accelerators than were described in the Ravenscroft disclosures. A sequestrant may be present in the second oxidation.

Coated ferrous metal articles are prepared according to these improved oxidation procedures. The improved oxidation solution for oxidizing at least a portion of an iron/oxygen enriched intermediate coating on a ferrous substrate to magnetite containing an alkali metal hydroxide, a sequestrant, and/or certain accelerators is also part of the present invention.

According to this invention, a seven-step procedure for forming a hybrid conversion coating on a ferrous metal substrate can incorporate the above-mentioned improvements to the first and the second oxidation procedures. The Ravenscroft disclosures describe the basic seven-step procedure as follows:

(1) subjecting the ferrous metal substrate to treatment selected from cleaning, degreasing, descaling, and mixtures thereof;

(2) rinsing the substrate from step (1) with water;

(3) subjecting the substrate from step (2) to a first oxidation to form a molecular iron/oxygen enriched intermediate coating;

(4) rinsing the substrate from step (3) with water;

(5) subjecting the substrate from step (4) to a second oxidation to form a predominantly magnetite, $Fe_3O_4$ coating;

(6) rinsing the substrate from step (5) with water; and (7) sealing the substrate with an appropriate topcoat.

The improvements provided to step (3) include using a reagent selected from (a) oxalic acid at a concentration of about 0.5–35 grams per liter, a pH of about 0.5–6.5, a temperature of about 50–150° F., and a contact time of about 0.5–10 minutes;

(b) and accelerator selected from the group consisting of organic and inorganic nitro compounds, a hydroxylamine accelerator, and mixtures thereof; and (c) a wetting agent; and optionally carrying out the process of step (3) by a slurry deposition.

The improvements to step (5) include using a reagent selected from (a) an aqueous solution containing alkali metal hydroxide at a concentration of about 20–1000 grams per liter;

(b) a sequestrant for hard water salts; and (c) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof.

DETAILED DESCRIPTION OF THE INVENTION

The Ravenscroft disclosures define a ferrous metal substrate as any metallic substrate whose composition is primarily iron. This may include steel, stainless steel, cast iron, gray and ductile iron, and sintered iron of all alloys.

The iron/oxygen rich intermediate coating applied to the substrate in the first oxidation can form using any of the water soluble dicarboxylic acids, especially aliphatic dicarboxylic acids generally of up to about five carbon atoms, such as oxalic, malonic, succinic, tartaric acids, and others and mixtures thereof. In addition, the inventors have now discovered that other water-soluble organic acids are suitable for the first oxidation. For example, other suitable acids include polycarboxylic acids with at least two carboxyl moieties, hydroxycarboxylic acids with one or more hydroxyl moieties and at least two carboxyl moieties, and aminocarboxylic acids with one or more amino and/or hydroxy moieties. Typical examples include citric, tartaric, succinic, ethylenediaminetetraacetic, and nitrilotriacetic acids. Typical salts include sodium, potassium, ammonium, and iron ammonium salts.

There are advantages and disadvantages to each dicarboxylic acid, as described in the Ravenscroft disclosures, and to each acid as newly described herein. The operation of first oxidation will need to be optimized for appropriate concentration, pH, temperature and immersion time dependent on the choice of carboxylic acid or phosphatizing solution. For example, oxalic acid is generally preferred for reasons related to reaction rate, solubility, cost and other factors. However, oxalic acid tends to form intermediate coatings of relatively coarse grain, with large crystals and the intermediate coating usually benefits from the addition of a grain refiner to the first oxidation, such as alkali metal compounds of tartrate, tripolyphosphate, molybdate, citrate, polyphosphate and thiocyanate, including sodium potassium tartrate, sodium citrate, sodium molybdate, sodium polyphosphate and sodium thiocyanate. An intermediate coating with a denser crystal structure is considered preferable because it tends to produce a resultant black finish (after the second oxidation) that is cleaner, with less rub off, and also thinner, which is desirable for most machine/tool applications. As will be described later herein, present research tends to indicate that the use of a hydroxylamine accelerator in the first oxidation reaction favors formation of a thinner, finer grained final black finish, with better adhesion and less rub off. Also, the present disclosure details further herein that the inclusion of a wetting agent in the first oxidation reaction favors a uniform deposition of the intermediate coating on the metal substrate surface.

According to the Ravenscroft disclosures, illustrative parameters for the first oxidation including oxalic acid were described to include an oxalic acid concentration of about 3–35 grams per liter, a pH of about 0.5–2.5, a temperature of about 50–150° F., and a contact time of about 0.5–5.0 minutes. Recent work has shown that lower concentrations, higher pH levels and longer contact times may often be used to optimize the quality of the final black finish, and/or to reduce the operating cost of the solution. Since some automated production scale process lines require longer dwell and transfer times to ensure smooth hoist operation and adequate computer programming flexibility, longer contact times may sometimes be desirable.

This disclosure now reports a broader range of operating conditions has now unexpectedly operable for the first oxidation. These broader operating conditions include concentration in a range of about 0.5–35 grams per liter, a pH of about 0.5–6.5, a temperature of about 50–150° F., and a contact time of about 0.5–10 minutes. Although these broader operating conditions are particularly applicable to oxalic acid as the first oxidation solution, they are also applicable to all other first oxidation solutions described herein. This disclosure also reports that the first oxidation may optionally proceed by slurry deposition. A typical slurry oxalate bath contains insoluble iron (II) oxalate at levels of about 10–50 grams per liter, a pH of about 3–7, a temperature of about 70–180° F. and contact times of about 0.5–10 minutes.

A mixture of two or more dicarboxylic acids tends to favor the formation of a denser microcrystalline structure on the metal surface, perhaps obviating the need for a grain refiner. For example, some preferred combinations of dicarboxylic acids would include oxalic and tartaric acids, and oxalic and citric acids. Experimental work has shown that oxalic acid is currently considered the primary reactant, while other dicarboxylic acids tend to moderate the action of oxalic acid due to differences in solubility and activity levels. Other dicarboxylic acids appear to function as grain refiners or to moderate the reaction rate. However, the costs of many of the commercial grades of other dicarboxylic acids are significantly higher than that of oxalic acid, the solubilities are lower and the reaction rates significantly lower as well. In fact, these other longer chain aliphatic dicarboxylic acids may actually require the use of accelerators instead of or in addition to grain refiners in order to be workable in a practical sense. The Ravenscroft disclosures described suitable accelerators for use in the first oxidation as including organic and inorganic nitro compounds, and alkali metal compounds of citrate, molybdate, polyphosphate, thiocyanate, chlorate, and sulfide, such as sodium chlorate, sodium molybdate, and organic nitro compounds. This disclosure additionally describes the use of hydroxylamine accelerators further herein.

The iron/oxygen rich intermediate coating can consist of iron phosphate in addition to dicarboxylate coatings. The Ravenscroft disclosures report that the iron phosphate coating does not appear to be quite as effective as the dicarboxylate coatings, because the iron phosphate deposit tends to be amorphous rather than crystalline. Though the adhesion of iron phosphate to the substrate is generally satisfactory, the amorphous iron phosphate deposit tends to be less durable and less resistant to rubbing and/or wear factors, thus appearing to have more sooty rub off in the final prepared article. The advantages of the phosphate coating, however, include the lower commercial cost of the chemicals and the ability to operate at higher (more neutral, less acidic) pH levels. These advantages improve worker safety aspects of the process line. Appropriate reagents for deposition of the water insoluble phosphate-based coating include phosphoric acid, as well as alkali metal acid phosphates, alkali metal pyrophosphates, primary alkanol amine phosphates, alkanol amine phosphates, alkanol amine pyrophosphates, and mixtures thereof. Typically, the iron phosphate solutions are able to operate at about pH 3.0–5.0 (dicarboxylates operate at about pH 1.0–2.0), at temperatures of about 70–130° F., and contact times of 1–3 minutes.

As discussed above, broader operating conditions (including concentration in a range of about 0.5–35 grams per liter, pH of about 0.5–6.5, about 50–150° F., contact time of about 0.5–10 minutes) apply to all first oxidation solutions, including iron phosphate solutions.

The Ravenscroft disclosures report that an intermediate coating with a more densely formed crystal structure tends to concentrate or increase the availability of iron and oxygen and thus tends to favor the formation of the magnetite in the second oxidation. A more densely formed crystal structure tends to facilitate the blackening of certain ferrous alloys of lower reactivity, such as heat-treated steels or more highly alloyed steels. Typically, these types of steels tend to be less reactive because the concentration of metallic iron at the surface is lower than that encountered with cast irons or softer steels. Consequently, it is considered preferable to design the composition of the iron/oxygen rich intermediate coating solution to maximize the crystal structure density of the intermediate coating, thereby overcoming any low initial reactivity of iron substrate. This disclosure later describes that hydroxylamine accelerators in the first oxidation favor a thinner, finer grained black finish with improved adhesion and less rub off. The use of slurry deposition in the first oxidation reported later herein results in a somewhat different overall crystal structure.

The Ravenscroft disclosures note that the operating temperature of the intermediate coating solution also has an effect on the reaction rate—higher temperatures tend to increase the reaction rate. Experimental evidence indicates that, although many iron alloys can successfully be processed at ambient temperatures, certain less reactive alloys benefit from application of the intermediate coating at temperatures of about 100–150° F. to overcome any low initial reactivity of the metal surface. This disclosure reports temperatures of up to about 180° F. for a slurry deposition for the first oxidation.

The Ravenscroft disclosures described suitable accelerators for use in the first oxidation as including organic and inorganic nitro compounds, alkali metal salts of citrate, tartrate, molybdate, polyphosphate, thiocyanate, chlorate and sulfide, such as sodium chlorate and sodium molybdate. Suitable concentrations for these accelerators were at concentrations of about 0.1–5.0 grams per liter. An alkali metal tartrate functions in as a suitable grain refiner in the first oxidation, typically at a concentration of about 0.1–1.0 gram per liter. This disclosure describes hydroxylamine accelerator as offering distinct advantages as an accelerator in the first oxidation.

The ferrous oxalate pretreatment described in the Ravenscroft disclosures result in the deposition of an intermediate iron (II) coating (with probably some amount of iron (III)) abundant in both molecular iron and molecular oxygen from the first oxidation solution onto the metal substrate surface. The intermediate coating serves as the source of reactive iron and oxygen for formation of magnetite in the second oxidizing bath. The intermediate iron (II) coating forms as a "conversion coating," because it deposits as a result of a precipitation reaction at the surface. Although we do not wish to be bound by any theory, we presently believe that the reaction mechanism may proceed as follows:

1. The acid in the first oxidation solution dissolves the metallic iron in an oxidation reaction: Fe (0) oxidizes to Fe (II) and Fe (III).

2. In the above reaction, the acid is reduced as it is being consumed at the iron-containing substrate surface, causing a localized rise in pH at the substrate surface.

3. This localized pH rise causes the iron (II) to precipitate immediately as an iron (II) salt of the acid in the first oxidation solution, deposited on the substrate surface.

As mentioned above, we have unexpectedly discovered that the intermediate iron (II) coating can deposit under a wide range of conditions including concentrations, pH levels, temperatures and contact times than the Ravenscroft disclosures reported.

In summary, then, the composition of the intermediate coating solution (the first oxidation) may take many forms, depending on the cost, solubility and activity level of the chemicals used, the pH of the solution and coarseness of the crystal structure. Other factors to consider include the initial reactivity of the iron metal alloy, the value or intended use of the article and other factors deemed pertinent to each application.

The Ravenscroft disclosures disclose that the blackening reaction (second oxidation) proceeds as long as there is a reactive iron and oxygen source at the substrate surface, such as an iron (II) oxalate coating deposited from a first oxidation solution containing oxalic acid. The iron (II) intermediate coating from the first oxidation acts as a reactant for conversion in the second oxidation (the blackening reaction) to magnetite by providing molecular iron and oxygen as well as nucleation sites that aid in the conversion to magnetite.

The first oxidation is believed to convert metallic iron, to Fe (II), when the coating is a ferrous dicarboxylate, or to a mixture of Fe (II) and Fe (III) when the coating is an iron phosphate. Accordingly, in this specification the dicarboxylate coating is designated as "ferrous," because the iron is in the ferrous or Fe (II) oxidation state, while the phosphate coating is designated more broadly as "iron," because the iron is in both the ferrous, Fe (II), and ferric, Fe (III), oxidation states. It is reasonable to believe that the primary iron oxide formed is $Fe_3O_4$, although it is possible that other iron oxides are formed, such as FeO and $Fe_2O_3$, and other compounds, such as FeS, SnS and SnO (due to the possible presence of sulfur and tin in the process solutions), all of which can be gray/black in color. The oxides of iron tend to be non-stoichiometric, and readily interconvertible with each other. The tendency of each of the iron oxides to be nonstoichiometric is due to some extent to the intimate relationship between their structures. The structure of each oxide may be visualized as a cubic close-packed array of oxide ions with a certain number of Fe (II) and/or Fe (III) ions distributed among octahedral and tetrahedral holes. Each of the iron oxides can alter its composition in the direction of one or two of the others without there being any major structural change, only a redistribution of ions among the tetrahedral and octahedral interstices. This accounts for their ready interconvertibility, their tendency to be nonstoichiometric, and, in general, the complexity of the Fe—O system. For further discussion of the oxides of iron, see, for example, Cotton and Wilkinson, *Advanced Inorganic Chemistry*, Interscience Publishers, 1966, 2nd edition, pages 847–862.

The second oxidation then converts at least a portion of the intermediate coating to trot magnetite. The exact reaction mechanism for the second oxidation has not been determined. However, the non-stoichiometric nature and easy interconvertibility of these iron compounds, as recognized by the art and discussed in Cotton, et al., makes it reasonable to believe that the resultant black coating is composed of a mixture of iron and oxygen that only loosely resembles precise or discrete compounds. After coating the article with the iron/oxygen rich intermediate coating, the article blackens by contact with a second oxidation solution at elevated temperatures to form magnetite. Experimental evidence indicates that most of the intermediate coating remains intact on the article surface after the second oxidation, with only a small portion of coating reacting to form magnetite. Although we do not clearly understand the exact reaction mechanism of the second oxidation, we believe that portions of the intermediate coating react with the second oxidation solution to form magnetite interspersed within the crystal structure of the coating. Some magnetite may chemically bond to molecules of the intermediate coating.

The composition of the second oxidation solution can vary, depending on the type, thickness and grain structure of the prepared intermediate coating. Generally, it is preferable to add at least one, two or even three oxidizers and an accelerator to the second oxidation solution. The primary oxidizers may be alkali metal compounds of hydroxide, nitrate, and nitrite and mixtures thereof. Specific examples of suitable primary oxidizers include sodium hydroxide, sodium nitrate and sodium nitrite in varying concentrations. In every case, however, the overall concentration of oxidizers according to the invention described in the Ravenscroft disclosures is significantly lower than that seen in conventional oxidizing processes described in the U.S. patents cited under the Background of the Invention.

The Ravenscroft disclosures describe components added to the second oxidation solution including accelerators, metal chelators and surface tension reducers. In addition, this disclosure now reports further herein a broader range of concentrations for the second oxidation solution, additional sequestrants, and additional thio-based accelerators.

Appropriate accelerators for the second oxidation described in the Ravenscroft disclosures included organic and inorganic nitro compounds, alkali metal compounds of citrate, molybdate, polyphosphate, vanadate, chlorate, tungstate, thiocyanate, dichromate, stannate, sulfide and thiosulfate, stannous chloride and stannic chloride, and mixtures thereof. Suitable accelerators also include sodium stannate, sodium thiosulfate, sodium molybdate and ethylene thiourea, sodium dichromate, sodium tungstate, sodium vanadate, sodium thiocyanate, benzothiazyl disulfide, and mixtures thereof. Such considerations as cost and solubility determine the choice of suitable accelerators. Preferably, accelerators are present at concentrations of about 0.05–0.5 grams per liter. Appropriate metal chelators described in the Ravenscroft disclosures included alkali metal compounds of thiosulfate, sulfide, ethylene diamine tetraacetate, thiocyanate, gluconate, citrate, and tartrate, and mixtures thereof. Such considerations as cost, solubility and reactivity determine the choice of suitable chelators. Preferably, chelators are present at concentrations of about 1.0–10.0 grams per liter. Appropriate surface tension reducers described in the Ravenscroft disclosures included alkylnaphthalene sulfonate and related compounds that are stable in high (basic) pH environments. Effective surface tension reducing agents include alkyl naphthalene sodium sulfonate, such as manufactured by the Witco Corporation under the trademark Petro AA, and similar surface tension reducing agents. Surface tension reducing agents tend to improve rinsability and reduce dragout from the solution. Typically, surface tension reducers are present at concentrations of about 0.025–0.2 grams per liter.

Suitable reaction parameters for the second oxidation are described as follows in the Ravenscroft disclosures: pH range: about 12.0–14.0, typically about 13.0–14.0; operating temperature range: about 120–220° F., typically about 160–200° F.; contact time range: about 0.5–20 min., typically about 5–10 min. Temperatures as low as about 70–80° F. at reaction times of 30 min. or more have proven successful.

The iron/oxygen rich intermediate coating (from the first oxidation) is responsible for reducing the minimum oxidizing potential necessary for satisfactory coatings. Since the intermediate coating solution (the first oxidation) has already oxidized the substrate metal, it is easier for a less powerful oxidation solution to finish the oxidation to the black magnetite level (the second oxidation). The second oxidation solution is unable to react with metallic iron; the second oxidation solution reacts only with the pre-existing, easily accessible iron and oxygen contained in the intermediate coating. Because the intermediate coating (from the first oxidation) facilitates the second oxidation reaction, a much less powerful second oxidation solution is required than has been typically used in conventional blackening processes.

In like manner, the operating temperature and contact time for the second oxidation is significantly reduced from similar parameters for conventional oxidizing solutions as described in the US patents listed under the Background of the Invention. According to the invention described in the Ravenscroft disclosures, the optimal temperature range for the second oxidation is about 190–220° F. for black coatings and about 160–190° F. for brown coatings. Optimal contact times are about 2–10 minutes.

Among the important advantages of the process of this invention and of the Ravenscroft disclosures are the surprisingly low temperatures at which this second oxidation may successfully operate. Reactions at temperatures as low as about 70–80° F. produce products with highly acceptable colored surface finish, generally by increasing the contact time, for example, up to about 30 min. or more. The ability to successfully operate at such surprisingly low temperatures offers substantial advantages in providing a process that an end user may perform safely and effectively. Such 'low temperature—longer time' procedures produce attractive finishes for less demanding final products, including such decorative and artistic products as ornamental wrought iron work, finish hardware, sculptural works, craft and artisan handworks, and similar enhancements. These finishes from the 'low temperature—longer time' procedures may evidence colors in the black to dark black-brown range. Further embellishment of the colored product may involve removal of some of the colored finish to reveal the bright underlying metal, achieving a patina or antique effect. Although it is of course known in reaction kinetics that lowering an operating temperature may call for increasing reaction times, the ability to operate at such surprisingly low temperatures has nowhere been reported in this industry, to the knowledge of the present inventors.

It is important to note that, in the second oxidation of this invention and the inventions of the Ravenscroft disclosures, the overall concentrations of the primary oxidizers and the relative concentrations of each oxidizer in the second oxidation solution are factors critical to success. The second oxidation solution cannot react with metallic iron, because the oxidizing potential of the solution is too low. Similarly, treating a ferrous substrate, as defined above, with a conventional oxidizing solution and merely reducing the concentration, temperature and contact time will not result in satisfactory finishes. In general, finishes obtained by treating a ferrous substrate with a conventional oxidizing solution at reduced concentration, temperature and contact time is a loosely adherent coating with an undesirable brown color.

The primary benefits derived from the process according to the Ravenscroft disclosures and the present invention are not related to the quality of the black finish itself, but rather to processing advantages. These improved advantages as described in the Ravenscroft disclosures include lower operating temperatures, shorter process times, and lower solution concentrations, which lead to enhanced worker safety and lower operating costs. The improved advantages of the present invention are described further later herein. The resultant black finish itself is very comparable to that of conventional blackening processes in terms of corrosion resistance, wear resistance, appearance, thickness, and applications in which the finished article is used.

The present inventive process, as well as those of the Ravenscroft disclosures, entails the deposition of an intermediate conversion coating, which is rich in iron and oxygen and represents a first oxidation of the metallic iron of the substrate. A second oxidation, which forms a magnetite compound by reacting with the intermediate coating, follows this first oxidation (forming the intermediate conversion coating). The precise chemical composition of the resultant black finish has not been identified. The chemical literature, as discussed above in the Background of the Invention, suggests that there are three oxides of iron, all of which are likely present in the intermediate conversion coating: FeO, $Fe_2O_3$ and $Fe_3O_4$ with $Fe_3O_4$ being a mixed salt of FeO and $Fe_2O_3$. Besides these iron oxides, it is likely that other salts form on the surface, including FeS, SnS, and SnO in minor quantities, due to the presence of sulfur and tin-based additives in the solution.

The first oxidation and the intermediate conversion coating of this invention, as well as those of the Ravenscroft disclosures, which may be a dicarboxylate, a phosphate, mixtures thereof, or some other iron/oxygen rich material, depending on the oxidation solution used, are not per se novel. The first oxidation and the intermediate conversion coating are in fact based on known chemistry. The novelty of the present invention is the use of these coatings (and the processes forming them) in the context of a blackening process. The novelty of the process, and the key to its success, lies in the second oxidation solution and its reaction with the intermediate coating. The concept of an initial oxidation of the metallic iron, to form an intermediate dicarboxylate, phosphate or other iron/oxygen enriched coating, followed by a further oxidation of the intermediate coating is a novel concept in this industry and depends on the composition and operating parameters of the second oxidization solution.

Our research as reported in the Ravenscroft disclosures did not indicate that the entire dicarboxylate, phosphate or other iron/oxygen-enriched intermediate coating from the first oxidation converts to iron magnetite, $Fe_3O_4$, in the second oxidation. Rather, our experimental work reported in the Ravenscroft disclosures suggests that the second oxidation solution is reacting with molecular iron and oxygen of the intermediate coating. Although the entire intermediate coating is rich in molecular iron and oxygen, it is reasonable to assume that the area in which these materials are most accessible is at the top surfaces of the intermediate coating crystal structure. Indeed, our tests reported in the Ravenscroft disclosures indicated that the black finish formed by the entire process (the first and the second oxidations) can be stripped off a steel article with hydrochloric acid, leaving a gray-looking finish behind. This gray-looking finish is believed to be the intermediate coating. Immersion in the second oxidation solution can then immediately re-blacken the article. We determined experimentally in the Ravenscroft disclosures that the second oxidation solution has no effect on metallic iron. The stripping and re-blackening experiment reasonably suggests that only the top surface of the intermediate coating is turning black. If the entire intermediate coating were being converted to black iron magnetite, the hydrochloric acid stripping operation would remove all of the coating, down to the metallic iron, and it would be impossible to re-blacken the article without first re-coating it with the intermediate coating.

EXAMPLES A

The following description of certain specific examples is primarily illustrative of the subject matter of the Ravenscroft disclosures. These examples are intended to be illustrative only and not limiting in any sense.

EXAMPLE A1

First Oxidation: A 1018 steel article is cleaned by conventional means. The cleaned article is then immersed for 1 minute at room temperature in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |
| Sodium Potassium Tartrate | 0.4 g/l |

The above immersion produces an opaque gray intermediate coating on the steel surface.

Second Oxidation: After rinsing, the intermediate coated article is immersed for 4–5 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Molybdate | 5 g/l |
| Stannous Chloride | 0.2 g/l |
| Petro AA | 0.1 g/l |

During this second immersion, the article gradually takes on a black color due to the formation of magnetite on the surface. The article is then rinsed in water and sealed in a water-displacing oil topcoat that serves as a rust preventative. The resultant coating is opaque black in color, tightly adherent, with corrosion resistance equal to that provided by the topcoat oil sealant.

EXAMPLE A2

First Oxidation: A 4140 heat-treated steel cutting tool is cleaned and descaled by conventional means. The tool is then immersed for 90 seconds at 120° F. in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |

The above immersion produces an opaque gray coating on the steel surface. Because 4140 steel is less reactive than 1018 steel of Example A1, the above oxidation solution has been modified from the first oxidation solution of Example A1 to eliminate the grain refiner (Sodium Potassium Tartrate) and to raise the operating temperature to make the reaction more aggressive.

Second Oxidation: After rinsing in water, the tool is immersed for 8 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Molybdate | 5 g/l |
| Stannic Chloride | 0.2 g/l |
| Petro AA | 0.1 g/l |

During the second immersion, the tool gradually takes on an opaque black color. The tool is then rinsed in water and sealed with a water-displacing rust preventive oil.

EXAMPLE A3

First Oxidation: A mild steel decorative article is cleaned by conventional means and immersed for 1 minute at room temperature in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |
| Sodium Potassium Tartrate | 0.4 g/l |

The above immersion will produce an opaque gray intermediate coating on the article surface after rinsing.

Second Oxidation: The article is then immersed for 6 minutes at 180° F. in an aqueous solution containing:

| | |
|---|---|
| Sodium Hydroxide | 100 g/l |
| Sodium Nitrate | 27 g/l |
| Ethylene Thiourea | 0.6 g/l |
| Tin (IV) Chloride | 2 g/l |
| Sodium Dichromate | 0.3 g/l |
| Petro AA | 0.1 g/l |

During the second immersion above, the article gradually takes on an opaque brown color. The article is then rinsed in clear water and sealed in a clear acrylic polymer-based topcoat. The resultant coating may serve as an aesthetic finish for decorative hardware, etc.

EXAMPLE A4

First Oxidation: A sintered iron metal article is cleaned by conventional means and immersed for 3 minutes at 120° F. in an aqueous solution containing:

| | |
|---|---|
| Phosphoric Acid | 28 g/l |
| Hydrofluosilicic Acid | 8 g/l |
| Xylene Sulfonic Acid | 3 g/l |
| Dodecylbenzene Sulfonic Acid | 2 g/l |
| Monoethanolamine | 17 g/l |
| Sodium m-Nitrobenzene Sulfonate | 1 g/l |
| Molybdenum Trioxide | 0.2 g/l |

After this immersion, the article has an intermediate coating of an opaque gray iron phosphate deposit.

Second Oxidation: After rinsing in water, the article is immersed for 5 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Tungstate | 5 g/l |
| Sodium Stannate | 0.2 g/l |
| Petro AA | 0.1 g/l |

During the above immersion, the article gradually takes on a black color. After rinsing in water, the article is sealed in a water-displacing rust preventive oil. The resultant finish is somewhat more fragile than that deposited in Examples A1 and A2, but may be considered preferable for certain applications because of the expected lower operating cost. In addition, the extremely porous substrate produced by this process may tend to make the fragile nature unimportant, depending on the end use of the article.

Because of the potentially dangerous nature of the prior known metal blackening processes, as described, e.g., in the patents listed under the Background of the Invention, many manufacturers have found it more convenient to send parts to an outside vendor for application of a black finish. This, of course, is inefficient and adds to the overall cost of production. A particular feature of this invention and of the Ravenscroft disclosures is a seven-step process that may be provided in a set-up of seven baths or containers, so that a metal manufacturer may safely and conveniently carry out in-house metal blackening without the risk to employees posed by such previous blackening procedures. This specification has described improvements to this seven-step process above. The inventive process described in the Ravenscroft disclosures may be a commercial seven-step process as follows:

Step 1: The article is cleaned, degreased and descaled (if necessary) to remove foreign materials such as fabricating oils, coolants, extraneous lubricants, rust, millscale, heat treat scale, etc. The aim here is to generate a metal surface that is free of oils and oxides, exposing a uniform and reactive metal surface. Any method of providing such a surface known to the metal finishing industry is suitable. Acceptable methods include conventional cleaning in an alkaline detergent soak cleaner, solvent degreasing or electrocleaning. Descaling can be accomplished by acid or caustic descaling methods. Abrasive cleaning methods such as bead blasting, shot peening and vapor honing provide good results. All these methods are well known to the metal finishing industry.

Step 2: The article is rinsed in clean water to remove any surface cleaning residues.

Step 3: (First Oxidation): The article is then subjected to a first oxidation to provide an intermediate coating on the metallic iron substrate. The oxidation reagent is an aqueous solution of either a dicarboxylate or a phosphate or mixtures thereof, optionally with a grain refiner, to provide a water insoluble dicarboxylate-based deposit or a water insoluble phosphate-based deposit, or mixtures thereof. Appropriate dicarboxylic acids include aliphatic dicarboyxlic acids, generally of up to about five carbon atoms, such as oxalic, malonic, succinic, glutaric, adipic, pimelic, maleic, malic, tartaric, or citric acid, and mixtures thereof. When the intermediate coating is a ferrous oxalate, suitable reaction parameters are as follows: pH range: about 0.5–2.5, typically about 1.6; operating temperature range: about 50–150° F., typically about 75° F.; contact time range: about 0.5–5.0 min., typically about 2 min.

Appropriate reagents for deposition of the water insoluble phosphate-based coating include phosphoric acid, as well as alkali metal acid phosphates, alkali metal pyrophosphates or primary alkanol amine phosphates. When the intermediate coating is an iron phosphate, suitable reaction parameters are as follows: pH range: about 3.0–5.5, typically about 4.0–5.0; operating temperature range: about 60–180° F., typically about 120 –130° F.; contact time range: about 1–10 min., typically about 3–5 min.

Appropriate grain refiners include alkali metal compounds of tartrate, tripolyphosphate, molybdate, citrate, polyphosphate and thiocyanate, such as sodium potassium tartrate. A suitable grain refiner is sodium potassium tartrate.

A suitable first oxidation solution according to this invention is prepared as follows:

| Component | Concentration | Acceptable Range |
|---|---|---|
| Oxalic acid | 14 g/l | 3–35 g/l |
| Phosphoric acid | 1.2 g/l | 0.5–3.0 g/l |
| Sodium m-Nitrobenzene sulfonate | 6 g/l | 1–15 g/l |
| Sodium Potassium Tartrate | 0.4 g/l | 0.1–2.0 g/l |

Contact time in this solution is usually about 1–3 minutes at about 50–150° F. The resulting deposition is an opaque, gray dicarboxylate intermediate coating.

Alternatively, an iron phosphating solution can be used to deposit an intermediate coating that is also effective. A suitable composition and acceptable range of concentrations for this option are shown below:

| Component | Concentration | Acceptable Range |
|---|---|---|
| Phosphoric acid | 28 g/l | 7–70 g/l |
| Hydrofluosilicic acid | 8 g/l | 2–20 g/l |
| Xylene Sulfonic acid | 3 g/l | 1–7.5 g/l |
| Dodecylbenzene sulfonic acid | 2 g/l | 1–5.0 g/l |
| Monoethanolamine | 17 g/l | 4–43.0 g/l |
| Sodium m-Nitrobenzene sulfonate | 1 g/l | 0.25–2.5 g/l |
| Molybdenum trioxide | 0.2 g/l | 0.05–0.5 g/l |

Contact time in this solution is usually about 1–3 minutes at about 80–150° F., resulting in the deposition of an opaque, gray iron phosphate intermediate coating.

Step 4: The article is rinsed in clean water to remove any surface acid solution residues.

Step 5: (Second Oxidation): The article is then oxidized to a colored surface by a second oxidation with an aqueous solution of oxidizing agents for a time sufficient to achieve the desired surface color. The composition of this second oxidation solution may include primary oxidizers along with such additional components as accelerators, metal chelators and surface tension reducers. Appropriate oxidizers include alkali metal compounds of hydroxide, nitrate, and nitrite. The oxidizing solution for the blackening reaction (the second oxidation) preferably contains three oxidizers, sodium hydroxide, sodium nitrate and sodium nitrite. If one of these oxidizers is omitted, the blackening reaction proceeds less efficiently.

Appropriate accelerators for the second oxidation include organic and inorganic nitro compounds, alkali metal compounds of citrate, molybdate, polyphosphate, vanadate, chlorate, tungstate, thiocyanate, dichromate, stannate, sulfide and thiosulfate, and stannous chloride and stannic chloride. Such considerations as cost and solubility affect the choice of suitable accelerators. Appropriate metal chelators include alkali metal compounds of thiosulfate, sulfide, ethylene diamine tetraacetate, thiocyanate, gluconate, citrate, and tartrate. Such considerations as cost, solubility and reactivity affect the choice of suitable chelators. Appropriate surface tension reducers include alkylnaphthalene sulfonate and related compounds that are stable in high pH environments.

Suitable reaction parameters for the second oxidation are as follows: pH range: about 12.0–14.0, typically about 13.0–14.0; operating temperature range: about 120–220° F., typically about 160–200° F.; contact time range: about 0.5–10 min., typically about 2–5 min.

Below are typical composition and concentration ranges for the Step 5 process solution:

| Component | Concentration | Acceptable Range |
|---|---|---|
| Sodium hydroxide | 100 g/l | 25–200 g/l |
| Sodium nitrate | 35 g/l | 8.75–70 g/l |
| Sodium nitrite | 5 g/l | 1–10 g/l |
| Sodium thiosulfate | 5 g/l | 1–10 g/l |
| Sodium molybdate | 5 g/l | 1–10 g/l |
| Tin (IV) Chloride | 0.2 g/l | .05–0.4 g/l |
| Petro AA | 0.1 g/l | .025–0.2 g/l |

Normal contact time for the second oxidation is about 2–10 minutes at about 160–220° F. The resulting coating may be black or brown in color, depending on exposure time, temperature and composition of the oxidizing solution.

Step 6: The article is rinsed in clean water to remove any oxidizing solution residues from the surface.

Step 7: The article is then sealed with a topcoat appropriate to the end use of the product, such as a lubricant, a rust preventive compound or a polymer-based topcoat.

Cleaning and rinsing techniques, such as those described above for Steps 1, 2, 4 and 6, may vary widely and are well known to the metal finishing industry. Many different such techniques can be used, depending on the condition of the metal surface prior to blackening, the volume of work to be done, the finish requirements for the final finish, etc. Consequently, alternate cleaning and rinsing techniques, as recognized within the metal finishing industry may be used and can be determined by the operator of the process. The specific cleaning and rinsing techniques described above should be considered merely illustrative.

Following is a description of parameters of a seven-step sequence as described above used to produce a black finish on a substrate of 1018 low carbon steel panel, which exemplifies operation of the process of this invention at the extraordinarily low temperature of 80° F.:

Step 1: The panel is cleaned as above described.

Step 2: The panel is rinsed as above described.

Step 3: (First Oxidation): The panel is coated with a dicarboxylate coating.

Step 4: The panel is rinsed as above described.

Step 5: (Second Oxidation): The panel is oxidized to a produce a black finish.

Suitable reaction parameters for the second oxidation are as follows: pH range: about 12.0–14.0, typically about 13.0–14.0; operating temperature range: about 80° F.; contact time range: about 30 min.

The composition and concentrations for this process solution are shown below:

| Component | Concentration |
|---|---|
| Sodium hydroxide | 175 g/l |
| Sodium nitrate | 60 g/l |
| Sodium nitrite | 10 g/l |
| Sodium thiosulfate | 10 g/l |
| Sodium molybdate | 8 g/l |
| Tin (IV) Chloride | 0.5 g/l |
| Petro AA | 0.2 g/l |

Step 6: The panel is rinsed as above described.

Step 7: The panel is then sealed with a topcoat appropriate to its end use as above described, such as with a lubricant, a rust preventive compound or a polymer-based topcoat.

Present Improvements to Composition and Method for Metal Coloring Process

The presently described improvements to the metal coloring composition and method of the Ravenscroft disclosures by this disclosure include improvements to the solution for forming the intermediate coating rich in molecular iron and oxygen (the first oxidation solution). Other improvements to the invention of the Ravenscroft disclosures by this disclosure include improvements to the solution for oxidizing the intermediate coating to a final magnetite coating (the second oxidation solution).

A. Improvements to the Intermediate Coating Solution (First Oxidation Solution

1. Increased Range of Operating Conditions

The Ravenscroft disclosures describe a first oxidation solution that includes oxalic acid at a concentration of about 3–35 grams per liter, pH of about 0.5–2.5, temperature of about 50–150° F., and contact time of about 0.5–5.0 minutes. It has now been unexpectedly discovered that lower oxalic acid concentrations, higher solution pH levels and longer contact times in this first oxidation can often optimize the quality of the final black finish, or reduce the operating cost of the solution. Since some production scale process lines are automated and require longer dwell and transfer times to ensure smooth hoist operation and adequate computer programming flexibility, longer contact times may sometimes be desirable.

Accordingly, a broader range of operating conditions includes an oxalic acid concentration in the range of about 0.5–35 grams per liter, a pH of about 0.5–6.5, a temperature of about 50–150° F. and a contact time of about 0.5–10 minutes.

2. Hydroxylamine Accelerators

The Ravenscroft disclosures described accelerators for the first oxidation as selected from organic and inorganic nitro compounds at concentrations of about 0.1–5.0 grams per liter. The specifically favored compound according to these prior patent disclosures was sodium m-nitrobenzene sulfonate. We have now surprisingly discovered that a hydroxylamine compound also functions as an accelerator. Hydroxylamine accelerator refers to any compound, such as a hydroxylamine salt or complex that provides hydroxylamine. Suitable examples of hydroxylamine accelerators include hydroxylamine salts, complexes, and mixtures thereof, such as hydroxylamine sulfate, phosphate and nitrate. The hydroxylamine accelerator may be present at a concentration of about 0.5–15 grams per liter, with a preferred range of 1–3 grams per liter. Hydroxylamine sulfate has been found to have a more moderate influence on the first oxidation reaction than sodium m-nitrobenzene sulfonate, leading to the formation of a thinner intermediate coating with tighter adhesion to the metal substrate. This favors the formation of a final black finish that is somewhat thinner with a finer grain, better adhesion and less rub off. Hydroxylamine sulfate also leads to a slower reaction that may be beneficial in certain process lines by giving the operator more latitude with respect to the contact times used.

Although the patent literature does not recognize the use of hydroxylamine sulfate as an accelerator in dicarboxylate reactions, the patent literature has noted the use of hydroxylamine sulfate as an accelerator in certain phosphatizing reactions. However, because the inventions of the Ravenscroft disclosures and of the present disclosure are based on the novelty of the two-oxidation-step procedure for forming a protective hybrid conversion coating on a ferrous metal substrate, the use of a hydroxylamine accelerator in a phosphatizing reaction (the first oxidation) of our overall procedure appears to be novel.

3. Slurry Deposition

According to the Ravenscroft disclosures, the pretreatment of the metal substrate results in the deposition of an iron (II) intermediate coating rich from the first oxidation solution onto the metal substrate surface. The intermediate coating serves as a source of reactive iron and oxygen for subsequent formation of magnetite in the second oxidizing bath. The iron (II) intermediate coating forms as a "conversion coating," meaning that it deposits as a result of a precipitation reaction at the substrate surface. Although not wishing to be bound by any specific theory, the reaction mechanism would appear to be as follows:

1. The first oxidation reaction begins by dissolution of metallic iron by the acid in the first oxidation solution. This would be an oxidation reaction: Fe (0) would oxidize to Fe (II) and Fe (III).

2. In the above reaction, the acid is reduced as it is being consumed at the substrate surface, thereby causing a localized rise in pH at the metal substrate surface.

3. This localized rise in pH is thought to cause the iron (II) to immediately precipitate as iron (II) oxalate, deposited on the metal substrate surface.

This reaction mechanism applies to iron dicarboxylate intermediate coatings, as well as to iron phosphate coatings.

We have unpredictably found that the intermediate coating (from the first oxidation) can deposit under a wide range of conditions entailing various concentrations, pH levels, temperatures and contact times. As an extension to the concept of depositing the intermediate coating from a solution, slurry deposition of solid iron (II) dicarboxylate or phosphate particles is useful and offers certain desirable advantages.

The Ravenscroft disclosures describe that the blackening reaction proceeds as long as there is a reactive iron and oxygen source at the metal substrate surface. A convenient reactive iron and oxygen source has been the intermediate iron (II) coating on the substrate surface, deposited from a first oxidation solution of dicarboxylic acid or phosphatizing solution. The intermediate coating acts as a reactant for conversion to magnetite (in the second oxidation) by providing molecular iron and oxygen as well as nucleation sites that aid in conversion of the intermediate coating to magnetite. That is, the intermediate coating provided reactive iron, oxygen and nucleation sites for subsequent blackening reaction (second oxidation).

In a slurry deposition method, we have now discovered that we may modify the first oxidation solution somewhat to operate at higher pH levels (more nearly neutral) that are less corrosive than those described in the Ravenscroft disclosures. The typical slurry bath utilizes a dicarboyxlic acid or a phosphatizing acid in solution along with a slurry of insoluble iron (II) particles as salts of the particular acid used. As a typical example, it may contain the specific acid at about 3–35 grams per liter, insoluble iron (II) salt at levels of about 1.0–50 grams per liter, at a pH of about 3–7, at a temperature of about 70–180° F., and with contact times of about 0.5–10 minutes. Because the slurry deposition method affords the ability to operate at higher pH levels, it makes the overall process less corrosive and hazardous. Additionally, in some process lines, slurry deposition may allow the possible elimination of the water rinse step prior to the blackening step (the second oxidation), shortening the overall process cycle and reducing the process operating costs.

The fundamental reaction taking place in the slurry deposition appears to be identical to that described in the Ravenscroft disclosures. The primary difference seems to be that, along with chemical deposition of iron (II) salt by precipitation described in the Ravenscroft disclosures, there evidently is some insoluble iron (II) salt particle deposition by purely physical or mechanical means. That is, particles tend to deposit on the metal substrate surface by lodging in microscopic substrate surface crevices, particularly when the substrate being blackened has been cleaned in an abrasive cleaning method that tends to roughen the substrate surface texture, e.g., shot peening or abrasive blasting. Additionally, as the iron (II) salt intermediate coating forms by chemical means, some particles of insoluble iron (II) salt may tend to lodge in this abraded coating at the metal surface. In the slurry deposition, the iron (II) intermediate coating appears to deposit by both chemical and physical means.

This slurry deposition method allows the iron (II) intermediate coating to deposit at a different rate and results in somewhat different overall crystal structure. However, the result is essentially the same—the preparation of an iron (II) intermediate coating as a source of reactive iron and oxygen for the subsequent blackening reaction (the second oxidation).

4. Wetting Agents (Surfactants)

According to the present disclosure, we have found that the inclusion of a wetting agent or surfactant in the first oxidation facilitates rinsing of the substrate metal surface and favors a more uniform intermediate coating deposition than noted in the process of the Ravenscroft disclosures without a wetting agent. However, the use of a wetting agent or surfactant is optional and not critical to the success of the overall process. The use of anionic surfactants, specifically of the sulfonate type, seems to afford best results. Suitable anionic surfactants include alkyl benzene sulfonic acid (and salts thereof, such as dodecyl benzene sulfonic acid and salts thereof) and alkyl naphthalene sulfonate (and salts thereof) at concentrations of about 0.05–0.2 grams per liter. Commercial alkyl naphthalene sulfonates and salts thereof, such as NAXAN® AAL and NAXAN® AAP from Rütgers Organics Corporation (formerly Ruetgers-Nease Corporation) of State College, Pa., appear to be effective.

Higher concentrations of a wetting agent in the first oxidation can interfere with proper formation of the iron (II) intermediate coating. Consequently, it is important to determine the optimum concentration for each application, depending on reactivity and surface texture of the metal substrate.

B. Improvements to the Blackening Solution (Second Oxidizing Solution)

1. Increased Range of Operating Conditions

The Ravenscroft disclosures describe the use of alkali metal hydroxide concentrations of 25–200 grams per liter in the second oxidation solution. We have now discovered that this second oxidation can successfully blacken certain steel articles that are very reactive in at alkali metal hydroxide concentrations as low as 20 grams per liter. Other non-reactive steel articles may require as much as 1000 grams per liter of alkali metal hydroxide. Consequently, this disclosure describes that the range of acceptable concentrations for the alkali metal can be about 20–1000 grams per liter.

2. Sequestrant

Certain blackening solutions (the second oxidation solution) may benefit from the inclusion of a sequestrant. A sequestrant appears to aid the blackening reaction by acting as a sequestrant for iron, calcium, magnesium and other hard water salts. Trisodium phosphate functions as a suitable sequestrant. Acceptable concentrations of trisodium phosphate can be about 5–15 grams per liter, with about 7–8 grams per liter being optimal.

3. Additional Accelerators

The Ravenscroft disclosures disclose the use of thio (sulfur bearing) accelerators for the blackening solution (second oxidation), such as ethylene thiourea, sodium thiosulfate, benzothiazyl disulfide and mixtures thereof. We have now discovered that other accelerators can successfully accelerate the blackening solution, including nitrates, thiourea, alkyl thioureas, dialkyl thioureas and mixtures thereof. Some of these thio-based materials are suspected carcinogens, and may be unacceptable for use on that basis.

Certain sulfur-containing amino acids may also be effective as accelerators. Cysteine and cystine are particularly attractive as accelerators for this second oxidation, because they are non-toxic and readily available at low cost.

Other suitable accelerators include alkali metal salts of oxyacids, such as tungstic, molybdic, permanganic, nitric, nitrous, hypochlorous, chlorous, chloric, bromic, and iodic acids, higher valent metal cations, such as tetravalent cerium, trivalent iron, tetravalent tin, and combinations thereof.

EXAMPLES B

The following description of certain specific examples is primarily illustrative of the novel subject matter of the present disclosure. These examples are intended to be illustrative only and not limiting in any sense.

EXAMPLE B1

First Oxidation

A 1018 steel panel is cleaned by conventional means. The cleaned article is then immersed for 5 minutes at room temperature in an aqueous solution containing:

| | |
|---|---|
| Oxalic acid | 5.0 grams per liter |
| Hydroxylamine sulfate | 3.0 grams per liter |
| Phosphoric Acid | 0.6 grams per liter |

The above immersion produces an opaque gray intermediate coating on the steel surface.

Second Oxidation

After rinsing, the intermediate coating coated article is immersed for 5 minutes at 200° F. in an aqueous solution containing:

| | |
|---|---|
| Sodium Hydroxide | 120 grams per liter |
| Sodium Nitrate | 40 grams per liter |
| Sodium Nitrite | 6 grams per liter |
| Sodium Thiosulfate | 6 grams per liter |
| Sodium Molybdate | 6 grams per liter |
| Ethylene Thiourea | 0.4 grams per liter |
| Potassium Thiocyanate | 2.0 grams per liter |

During this second immersion, the article takes on an opaque black finish with minimal ruboff. The article is then rinsed in water and sealed in a water-displacing oil topcoat that serves as a rust preventive.

EXAMPLE B2

First Oxidation

A heat-treated steel forging is sandblasted to remove residual heat treat scale, then cleaned by conventional means. The cleaned article is then immersed for 4 minutes at room temperature in an aqueous solution containing:

| | |
|---|---|
| Oxalic Acid | 2.5 grams per liter |
| Hydroxylamine sulfate | 1.5 grams per liter |
| Phosphoric Acid | 0.3 grams per liter |

The above immersion produces an opaque gray intermediate coating on the steel surface.

Second Oxidation

After rinsing, the intermediate coated article is immersed for 10 minutes at 200° F. in an aqueous solution containing:

| | |
|---|---|
| Sodium Hydroxide | 40 grams per liter |
| Sodium Nitrate | 14 grams per liter |
| Sodium Nitrite | 2 grams per liter |
| Sodium Thiosulfate | 2 grams per liter |
| Sodium Molybdate | 2 grams per liter |
| Ethylene Thiourea | 0.2 grams per liter |
| Potassium Thiocyanate | 1 gram per liter |

During this second immersion, the article gradually takes on a black color with minimal ruboff, due to the formation of magnetite on the surface. The article is then rinsed in water and sealed in a water-emulsified oil topcoat that serves as a rust preventive.

EXAMPLE B3

First Oxidation

A 1008 steel stamping is cleaned by conventional means. The cleaned article is then immersed for 5 minutes at room temperature in an aqueous solution containing:

| | |
|---|---|
| Oxalic Acid | 2.5 grams per liter |
| Hydroxylamine sulfate | 1.5 grams per liter |
| Phosphoric Acid | 0.3 grams per liter |

The above immersion produces an opaque gray intermediate coating on the steel surface.

Second Oxidation

After rinsing, the intermediate coated article is immersed for 12 minutes at 200° F. in an aqueous solution containing:

| | |
|---|---|
| Sodium Hydroxide | 50 grams per liter |
| Sodium Nitrate | 18 grams per liter |
| Sodium Nitrite | 2.5 grams per liter |
| Sodium Thiosulfate | 2.5 grams per liter |
| Sodium Molybdate | 2.5 grams per liter |
| L-cystine | 1.0 gram per liter |
| Potassium Thiocyanate | 1.0 gram per liter |

During this second immersion, the article gradually takes on a black color due to the formation of magnetite on the surface. The article is then rinsed and sealed in a topcoat oil that serves as a rust preventive.

EXAMPLE B4

First Oxidation

A stamped mild steel bracket is cleaned by conventional means. It is then rinsed and immersed for 5 minutes at room temperature in an aqueous solution identical to that described in Example B3. The resultant opaque gray intermediate coating is then rinsed in water.

Second Oxidation

After rinsing, the article is immersed for 5 minutes at 200° F. in an aqueous solution containing:

| | |
|---|---|
| Sodium Hydroxide | 100 grams per liter |
| Sodium Nitrate | 35 grams per liter |
| Sodium Nitrite | 5 grams per liter |
| Sodium Molybdate | 5 grams per liter |
| Sodium Thiosulfate | 5 grams per liter |
| Stannous Chloride | 0.2 grams per liter |
| Potassium Thiocyanate | 1.7 grams per liter |
| L-cystine | 0.2 grams per liter |

During the second oxidation, the article gradually takes on the opaque black color of magnetite. The addition of the cystine tends to accelerate the reaction rate and reduces the amount of ruboff. The article is then rinsed and sealed with a water displacing rust preventive.

EXAMPLE B5

Slurry Deposition

First Oxidation

A stamped mild steel bracket is cleaned by conventional means. The article is then immersed for 3 minutes at 140° F., and at a pH of 6.5, in an aqueous suspension containing:

| | |
|---|---|
| Iron (II) Oxalate | 10 grams per liter |
| Sodium m-nitrobenzenesulfonate | 2 grams per liter |

Iron (II) Oxalate is only sparingly soluble and held in suspension with vigorous agitation. Immersion of the article in this suspension produces a loosely adherent gold colored coating.

Second Oxidation

The article is not rinsed in water following immersion in the slurry, since the coating is less adherent than those intermediate coatings previously described in Examples B1, B2, and B3. The near-neutral pH of the residual slurry on the surface of the article does not represent a significant contamination of the subsequent oxidizing bath. The article is then immersed in a second oxidation bath similar in composition to that described in Example B4 until a black color develops on the surface. The final finish is then water rinsed and sealed with a rust preventive oil topcoat.

EXAMPLE B6

First Oxidation

A heat-treated steel forging is sand blasted to remove the residual heat treat scale, and then cleaned by conventional means. The article is then immersed for 1 minute at room temperature in an aqueous solution containing:

| | |
|---|---|
| Oxalic acid | 1 gram per liter |
| Sodium m-nitrobenzenesulfonate | 0.3 gram per liter |
| Phosphoric acid | 0.1 gram per liter |

This immersion produces a very thin, gray intermediate coating on the steel surface.

Second Oxidation

After rinsing in water, the article is immersed for 10 minutes at 205° F. in an aqueous solution containing:

| | |
|---|---|
| Sodium Hydroxide | 150 grams per liter |
| Sodium Nitrate | 50 grams per liter |
| Sodium Nitrite | 7 grams per liter |
| Sodium Molybdate | 7 grams per liter |
| Sodium Thiosulfate | 7 grams per liter |
| Stannous Chloride | 1 gram per liter |
| Potassium Thiocyanate | 2 grams per liter |
| Ethylene Thiourea | 0.5 grams per liter |

During the second oxidation, the article gradually takes on an opaque, glossy black finish. The article is then rinsed in water and sealed in a rust preventive topcoat.

What is claimed is:

1. A process for forming a hybrid conversion coating on a ferrous metal substrate, comprising the steps of:

(a) applying to the substrate an intermediate coating rich in molecular iron and oxygen by contacting the substrate with a reagent of (1) an aqueous solution of oxalic acid at a concentration of about 0.5–35 grams per liter, a pH of about 0.5–6.5, a temperature of about 50–150° F., and a contact time of about 0.5–10 minutes;

(2) an accelerator selected from organic and inorganic nitro compounds, a hydroxylamine accelerator, and mixtures thereof; and (3) a wetting agent;

optionally by a slurry deposition; and (b) contacting the coated substrate of step (a) with an aqueous solution of oxidizing agents to form a surface that is predominantly magnetite, $Fe_3O_4$.

2. A process according to claim 1, wherein the hydroxylamine accelerator is selected from hydroxylamine salts, hydroxylamine complexes, and mixtures thereof.

3. A process according to claim 1, wherein the hydroxylamine accelerator is hydroxylamine sulfate.

4. A process according to claim 1, wherein the hydroxylamine accelerator is present at a concentration of about 0.5–15 grams per liter.

5. A process according to claim 1, wherein the hydroxylamine accelerator is present at a concentration of about 1–3 grams per liter.

6. A process according to claim 1, wherein step (a) comprises a slurry deposition method of contacting the substrate with a reagent selected from (i) an aqueous solution of dicarboxylic acids, and salts, and mixtures thereof, and (ii) an aqueous solution of a reagent selected from phosphoric acid, pyrophosphoric acid and salts and mixtures thereof, at a concentration, pH, temperature and time to achieve the intermediate coating.

7. A process according to claim 6, wherein step (a) comprises a slurry deposition method of contacting the substrate with a reagent selected from an aqueous solution of a dicarboxylic acid and salts and mixtures thereof, at a concentration, pH, temperature and time to achieve the intermediate coating.

8. A process according to claim 7, wherein in step (a) the reagent is selected from an aqueous solution of oxalic acid and salts and mixtures thereof.

9. A process according to claim 8, wherein in step (a) the reagent is present at 3–35 grams per liter, insoluble iron (II) oxalate levels in the slurry deposition are about 1.0–50 grams per liter, pH is about 3–7, temperature is about 70–180° F., and about 0.5–10 minutes.

10. A process according to claim 1, wherein the wetting agent is selected from an anionic surfactant, a sulfonate anionic surfactant, alkyl benzene sulfonic acid and salts thereof, alkyl naphthalene sulfonate, salts thereof, and mixtures thereof.

11. A process according to claim 10, wherein the wetting agent is present at a concentration dependent on reactivity and surface texture of the substrate.

12. A process according to claim 10, wherein the wetting agent is present at a concentration about 0.05–0.2 grams per liter.

13. A process for forming a hybrid conversion coating on a ferrous metal substrate, comprising the steps of:

(a) applying to the substrate an intermediate coating rich in molecular iron and oxygen; and (b) contacting the coated substrate of step (a) with a reagent of (1) an aqueous solution of oxidizing agents containing alkali metal hydroxide at a concentration of about 20–1000 grams per liter;

(2) a sequestrant; and (3) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof;

to form a surface that is predominantly magnetite, $Fe_3O_4$.

14. A process according to claim 13, wherein the sequestrant is trisodium phosphate.

15. A process according to claim 14, wherein trisodium phosphate is present at a concentration of 5–15 grams per liter.

16. A process according to claim 14, wherein trisodium phosphate is present at a concentration of 7–8 grams per liter.

17. A process according to claim 13, wherein the accelerator is selected from thiourea, alkyl thiourea, dialkyl thiourea, cysteine and cystine, and mixtures thereof.

18. A ferrous metal article having a surface formed by two treatments, wherein the first treatment comprises an iron/oxygen-enriched intermediate oxidized coating formed on the ferrous metal article with an aqueous solution containing a reagent of (a) oxalic acid at a concentration of about 0.5–35 grams per liter, a pH of about 0.5–6.5, a temperature of about 50–150° F., and a contact time of about 0.5–10 minutes;

(b) an accelerator selected from organic and inorganic nitro compounds, a hydroxylamine accelerator, and mixtures thereof; and (c) a wetting agent;

optionally by a slurry deposition, and the second treatment comprises a further oxidation of the first coating to convert the first coating to a magnetite coating on the ferrous metal article.

19. A ferrous metal article having a surface formed by two treatments, wherein the first treatment comprises an iron/oxygen-enriched intermediate oxidized coating formed on the ferrous metal article, and the second treatment comprises a further oxidation containing a reagent of (a) an alkali metal hydroxide at a concentration of about 20–1000 grams per liter;

(b) a sequestrant; and (c) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof;

to convert the first coating to a magnetite coating on the ferrous metal article.

20. A process for forming a hybrid conversion coating on a ferrous metal substrate, comprising the steps of:

(1) subjecting the ferrous metal substrate to treatment selected from cleaning, degreasing, descaling, and mixtures thereof;

(2) rinsing the substrate from step (1) with water;

(3) subjecting the substrate from step (2) to a first oxidation containing a reagent of (a) oxalic acid at a concentration of about 0.5–35 grams per liter, a pH of about 0.5–6.5, a temperature of about 50–150° F., and a contact time of about 0.5–10 minutes (b) an accelerator selected from organic and inorganic nitro compounds, a hydroxylamine accelerator, and mixtures thereof; and (c) a wetting agent optionally by a slurry deposition to form a molecular iron/oxygen enriched intermediate coating;

(4) rinsing the substrate from step (3) with water;

(5) subjecting the substrate from step (4) to a second oxidation to form a predominantly magnetite, $Fe_3O_4$ coating;

(6) rinsing the substrate from step (5) with water; and (7) sealing the substrate with an appropriate topcoat.

21. A process for forming a hybrid conversion coating on a ferrous metal substrate, comprising the steps of:

(1) subjecting the ferrous metal substrate to treatment selected from cleaning, degreasing, descaling, and mixtures thereof;

(2) rinsing the substrate from step (1) with water;

(3) subjecting the substrate from step (2) to a first oxidation to form a molecular iron/oxygen enriched intermediate coating;

(4) rinsing the substrate from step (3) with water;

(5) subjecting the substrate from step (4) to a second oxidation with a reagent selected from (a) an aqueous solution containing alkali metal hydroxide at a concentration of about 20–1000 grams per liter;

(b) a sequestrant for hard water salts; and (c) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof;

to form a predominantly magnetite, $Fe_3O_4$ coating;

(6) rinsing the substrate from step (5) with water; and (7) sealing the substrate with an appropriate topcoat.

22. A ferrous metal article prepared according to a process for forming a hybrid conversion coating on a ferrous metal substrate, comprising the steps of:

(a) applying to the substrate an intermediate coating rich in molecular iron and oxygen with a reagent selected from (1) an aqueous solution of oxalic acid at a concentration of about 0.5–35 grams per liter, a pH of about 0.5–6.5, a temperature of about 50–150° F., and a contact time of about 0.5–10;

(2) an accelerator selected from organic and inorganic nitro compounds, a hydroxylamine accelerator, and mixtures thereof; and (3) a wetting agent;

optionally by a slurry deposition; and (b) contacting the coated substrate of step (a) with an aqueous solution of oxidizing agents to form a surface that is predominantly magnetite, $Fe_3O_4$.

23. A combination, comprising: (A) a ferrous metal article with water insoluble dicarboxylate or iron phosphate formed on the surface of the ferrous metal article by contact with, or optionally by a slurry deposition of, an aqueous solution containing a reagent comprised of(i) oxalic acid at a concentration of about 0.5–35 grams per liter, a pH of about 0.5–6.5, a temperature of about 50–150° F., and a contact time of about 0.5–10 minutes; (ii) an accelerator selected from organic and inorganic nitro compounds, a hydroxylamine accelerator, and mixtures thereof, and (iii) a wetting agent; (B) an aqueous oxidation solution comprised of (i) water, (ii) alkali metal hydroxide at a concentration of about 20 to about 1000 grams per liter, (ii) a sequestrant, and (iii) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof; and (C) a predominantly magnetite coating formed on the surface of the water insoluble dicarboxylate or iron phosphate coated ferrous metal article upon contact with the aqueous oxidation solution.

24. A combination, comprising: (A) a ferrous metal article with water insoluble dicarboxylate or iron phosphate formed on the surface of the ferrous metal article; (B) a reagent for comprising (i) an alkali metal hydroxide at a concentration of about 20 to about 1000 grams per liter, (ii) a sequestrant, and (iii) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof; and (C) a predominantly magnetite coating formed on the surface of the water insoluble dicarboxylate or iron phosphate coated ferrous metal article upon contact with the reagent.

25. An oxidation-reduction combination comprising (A) an aqueous solution, at a temperature in the range of about 50 to about 180 degrees Fahrenheit, containing a reagent comprised of (a) alkali metal hydroxide at a concentration of about 20 to about 1000 grains per liter; (b) a sequestrant; and (c) an accelerator selected from organic and inorganic nitro compounds, alkali metal compounds of citrate, molybdate, polyphosphate, vanadate, chlorate, tungstate, thiocyanate, dichromate, stannate, sulfide and thiosulfate, stannous chloride, stannic chloride, ethylene thiourea, benzothiazyl disulfide, thiourea, alkyl thiourea, dialkyl thiourea, cysteine, cystine, and mixtures thereof; (B) a ferrous metal article having a water insoluble dicarboxylate or iron phosphate coating formed on the surface of the ferrous metal article; and (C) a predominantly magnetite coating formed on the surface of the water insoluble dicarboxylate or iron phosphate coated ferrous metal article upon contact with the aqueous solution.

* * * * *